US006460691B1

(12) United States Patent
Gaensewig et al.

(10) Patent No.: US 6,460,691 B1
(45) Date of Patent: Oct. 8, 2002

(54) FILLING MACHINE

(76) Inventors: Horst Gaensewig, 14 Heathmore Court, Unionville, Ontario (CA), L3R 8G1; Kenneth Jorgensen, 5268 Forestwalk Circle, Mississauga, Ontario (CA), L4Z 4A1; Derek Fitton, 22 Weneil Drive, Freelton, Ontario (CA), L0R 1K0

( * ) Notice: Subject to any disclaimer, the term of this patent is extended or adjusted under 35 U.S.C. 154(b) by 0 days.

(21) Appl. No.: 09/694,208

(22) Filed: Oct. 23, 2000

(51) Int. Cl.[7] ..... B65G 17/12
(52) U.S. Cl. ..... 198/793; 198/844.1
(58) Field of Search ..... 198/793, 844.1, 198/618, 379, 606

(56) References Cited

U.S. PATENT DOCUMENTS 5,624,021 A * 4/1997 Novak et al. ..... 198/626.1

* cited by examiner

*Primary Examiner*—Kenneth W. Noland
(74) *Attorney, Agent, or Firm*—M. J. McGreal

(57) ABSTRACT

This invention is directed to improved parts for a container filling machine, and in particular, to a tube filling machine. It has been found that moving parts of such machines that come into contact with the products being packaged shall be constructed of plastics that have a Durometer hardness of more than about 65D and preferably more than about 70D. In particular, the plastic should be a polyurethane. Such a plastic has a low wear rate in the presence of products which contain abrasives, such as toothpastes.

10 Claims, 2 Drawing Sheets

FILLING MACHINE

FIELD OF THE INVENTION

This invention relates to an improved filling machine for filling containers with products containing abrasive materials. More particularly, this invention relates to improved product container holders for filling machines during the filling of such containers.

BACKGROUND OF THE INVENTION

Many products are filled into the containers in which they are to be sold on high speed filling lines. These lines can fill from about 100 to more than 500 containers a minute. Usually in these filling lines the container will be transported to and from one or more filling stations. Also, a filling station can have a plurality of filling nozzles so that a plurality of containers can be filled at one time. This all requires the coordinated moving of the containers to the filling nozzles, filling and transporting the containers away from the filler nozzles for container sealing and further packaging such as cartoning or shrink wrapping.

One problem that arises on high speed filling lines is that there are misfillings at the filler station. This can be caused by a container not being in alignment with the filler nozzle when the filler nozzle enters the container or the container being defective. If the product is a liquid the mess created is not too great. It also is relatively easy to clean. Gel, paste and powder products create more of a mess, with many of these products also contributing to an increased wear rate for the machine parts. This particularly is the case with bearings, hinge pins, bushings and the like when in contact with a product which contains an abrasive. Such products include toothpastes. Toothpastes by their nature include a particulate abrasive to remove plaque and tartar from teeth. These abrasives include particulate silica, alumina, zeolite, calcium carbonate and phosphates. In a misfill these abrasive containing products get into moving part areas such as bearings, bushings, attaching pins and hinge pins. Such products will increase the wear rate of these parts and require the repair or replacement of these parts at shorter intervals.

This particularly is a problem with dentifrice tube fillers. A common dentifrice tube filler has aluminum tube holder supports, also known as links. The tube holder will fit into, and be supported by, tube holder supports. However, the aluminum tube holders supports experience increased wear and must be repaired and/or replaced at relatively short intervals. This takes a filler out of production for a period of time. This results in lost product production. There also is an increased cost for any repair costs and for the replacement of tube holder supports.

BRIEF SUMMARY OF THE INVENTION

This invention solves the problem of excessive wear of filler equipment parts, and in particular, container holder supports, when used to fill products which contain abrasives. The solution is to use a plastic and preferably a polyurethane plastic, that has a Durometer hardness of more than about 65D and preferably more than about 70D in place of aluminum as the material of the container holder supports. This plastic preferably is used to form the entire container holder support links. The use of links from this plastic in place of aluminum container holder links results in a tube holder link that has a wear rate of 25 to 50% of that of an aluminum tube holder link. Also such links are about 30 to 50 percent of the weight of aluminum links.

The preferred polyurethane links are formed by combining polyurethanes having a Durometer of from about 60D to about 90D to produce a polyurethane having a Durometer of more than about 65D and preferably more than about 70D, and most preferably about 72D. The polyurethane blend is held at pressure in a compression mold for about 15 minutes to 60 minutes, and preferably about 30 minutes. This is followed by a curing in an oven at about 100° C. to about 130° C., and preferably about 110° C. to about 125° C. for about 12 to 48 hours, and preferably about 18 to 30 hours. Each container holder support link undergoes this processing to form the polyurethane link having a hardness of more than about 65D and preferably more than about 70D.

DETAILED DESCRIPTION OF THE INVENTION

The invention will now be described with regard to a preferred mode and with reference to the attached drawings.

Figure 1:
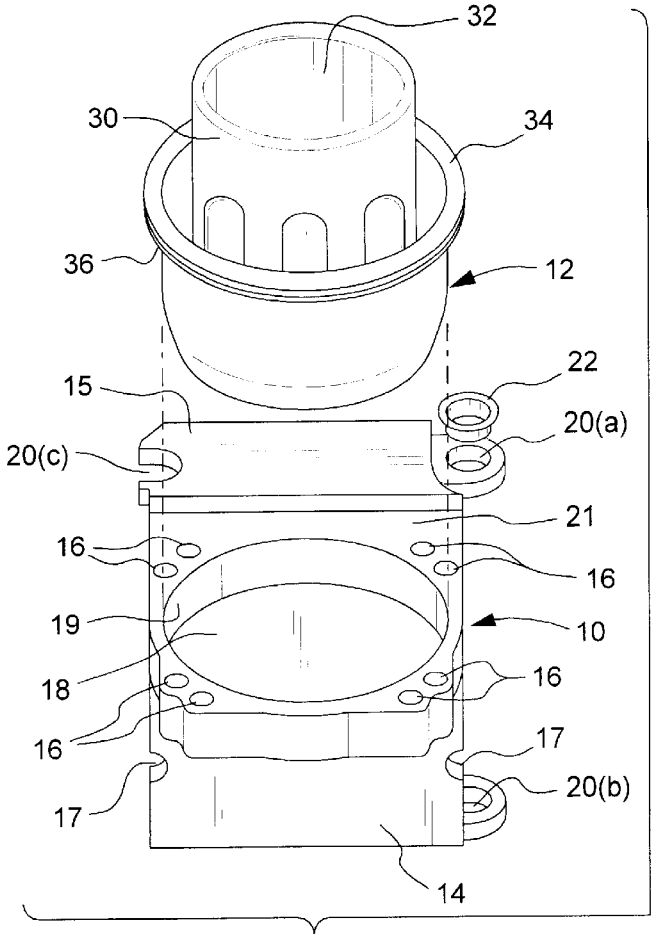
FIG. 1 is a side elevational exploded view of the container holder and the container holder support.

FIG. 1 shows in an exploded view a container holder 12 and a container holder support 10 also known as a link. The container holder 12 is designed to hold a container of a particular shape. In the preferred embodiment of the present invention the container holder is shaped to hold a cylindrical container such as a tube. The aperture 32 will be circular formed by a cylindrical sidewall 30. A flange 34 is sized to support the container holder in the container holder support 10. The container holder will be constructed of a suitable plastic and may have a metal ring 36 on the underside of flange 34.

Figure 2:
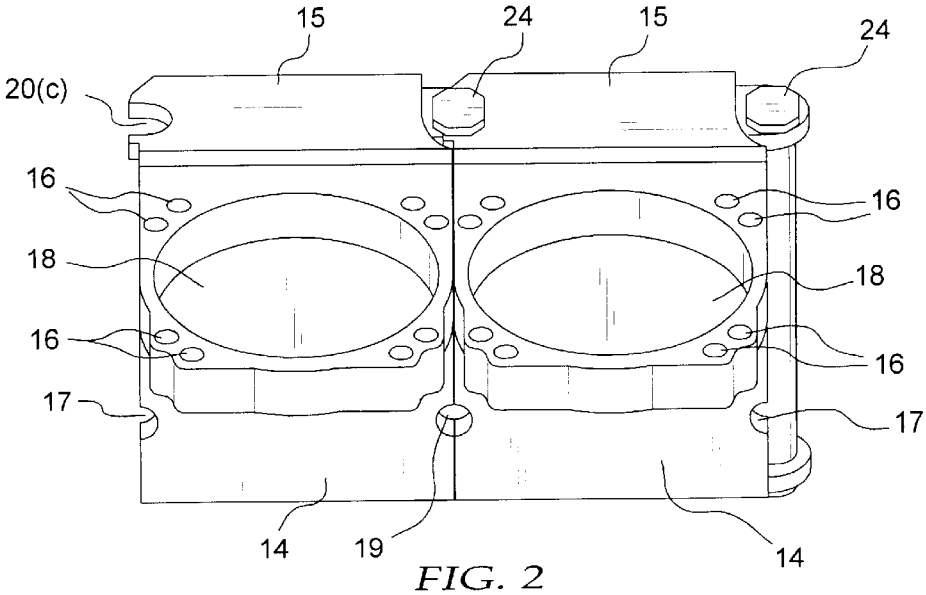
FIG. 2 is a view of container holder supports connected together.

The container holder support 10 is comprised of a support section 21 and an attachment section 14. The attachment section attaches the container holder support 10 to a transport belt via slots 17 using conventional fasteners. The aperture 18 of support section 21 formed by wall 19 is sized to accept the container holder 12. The rim 34 of the container holder will rest on the support section 21. Shown embedded in support section 21 are a series of magnets 16 which hold the container holder 12 in place on the container holder support 10. This is through the metal ring 36 on the lower surface of rim 34. On top surface 15 are hinge slots 20(*a*), 20(*b*) and 20(*c*) with hinge slots 20(*a*) and 20(*b*) having a bushing 22 {not shown for slot 20(*b*)} and a hinge pin 24 (shown in FIG. 2). Slot 20(*c*) interfits onto a slot 20(*a*) and bushing 22 of a neighboring container holder support as shown in FIG. 2. The bushing preferably will be constructed of a plastic such as nylon and the hinge pin preferably will be a stainless steel.

FIG. 2 shows two container holder supports 10 assembled together. In actual use these container holder supports will be assembled together in from about 30 to about 70 units in a chain-like array. As shown in FIG. 2, a slot 20(*c*) of one container holder support will interfit with the bushing 22 of slot 20(*a*). The slot 20(*b*) of one container holder support will interfit into a recess in another container support. A pin 24 extends down through the bushing of slot 20(*a*) extending through the bushing of slot 20(*b*). This slot and pin arrangement forms the container holder supports into the chain-like array. A conventional fastener through slot apertures 17 attaches the container holder supports to the transport belt (not shown) that is driven by an electric motor. The transport belt moves the container holder supports in a chain-like array in a circular or elliptical path.

Figure 3:
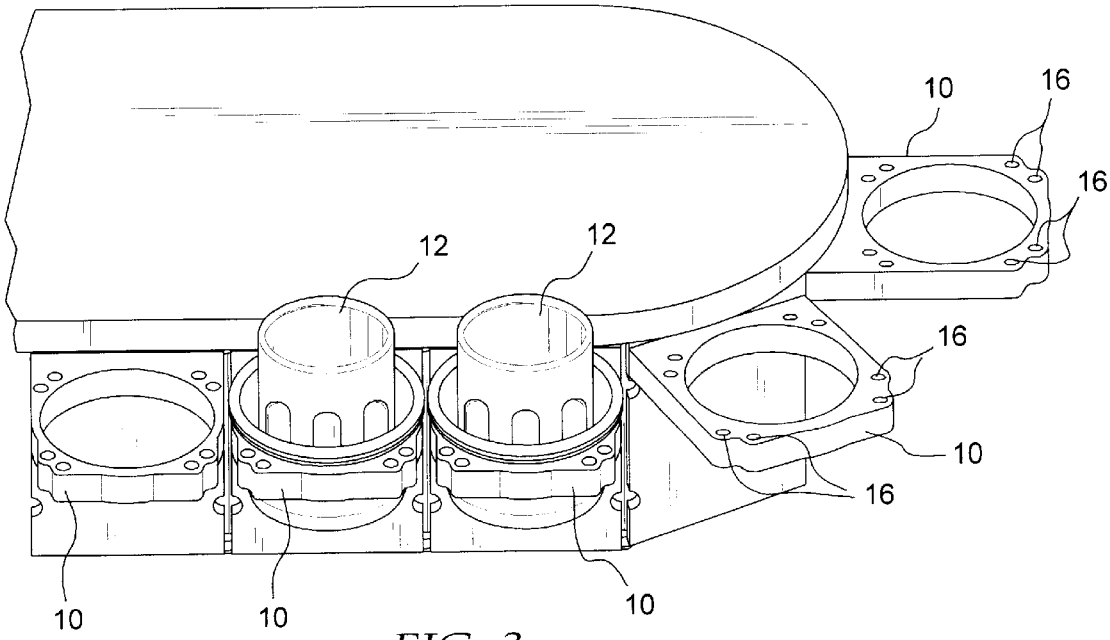
FIG. 3 is a perspective view of the container holder support and container holder on a filling machine.

FIG. 3 shows the container holder supports 10 and containers 12 in an array on a filling machine. In use each container support 10 will have a container holder 12. The three container holder supports not having a container holder are for illustrative purposes. The container holder supports are held in place by the hinge pins and the attachment to the moving band. The container holder supports will travel in an oval path. In this path there will be a rotation of the bushings 22 with relation to the hinge pins 24 at the ends of the oval. It is this rotation that causes wear of the bushings and the hinge pins. This wear becomes excessive when the product being packaged into a tube contains an abrasive. The slots 20(*a*), 20(*b*) and 20(*c*) show excessive wear.

As noted, these container holder supports are joined together in a series by the hinges to form a continuous chain-like circular or elliptical array. They can be mounted on a filler machine such as a Norden 700 or 1200 filler. The container holders will receive an inverted container to be filled such as a tube closed at one end. The tube is transported to a filler nozzle and the tube and tube holder are raised upward to a filling nozzle and are lowered as they are being filled. The filled tubes then move to a sealing station where the open end is crimp sealed closed. The filled and now closed tubes are transported to an ejection station where they are moved to cartoning or shrink wrapping.

As also noted, problem with regard to these container holder supports is that when a product that contains abrasives there is wear at the hinges. The product gets into the hinges and causes increased wear. This leads to premature repair and replacement. This can be obviated through the use of plastic having a Durometer hardness (D) of about 65D to about 90D, and preferably about 70D to 85D. A preferred plastic is polyurethane that is comprised of a mixture of a resin having a 65D and a resin having an 85D. The mixture when processed will have a hardness of about 72D. Besides having a greater wear resistance, this plastic has a weight about 30 to about 50 percent of comparable aluminum units. This reduces the wear on other filler parts.

The container holder support is formed by compression molding. The molded piece is maintained in the mold for about 15 to about 60 minutes, preferably about 30 minutes, removed and cured in an oven at temperature of about 100° C. to about 130° C., and preferably about 110° C. to 125° C., for about 12 to 48 hours. A preferred time in the compressor mold is about 12 to about 48 hours, preferably about 18 to about 30 hours, and most preferably about 24 hours. After curing, the container holder support is ready for use.

Although polyurethanes of the noted hardness have been found to be very useful, other plastics having a similar Durometer hardness can be used. This is not restricted to the use of polyurethane resins.

What is claimed is:

1. An apparatus for filling containers with a product containing abrasive material comprising plurality of holders for containers, said plurality of container holders attached to a plurality of container holder support link that is attached to a belt for moving said holders to a receiving station for the containers, to a filling station for filling said containers with said product, and to a discharge station where said containers are discharged for said tube holders, the improvement comprising said plurality of tube holder support links being constructed form a plastic material having a Durometer hardness of more than about 65D.

2. An apparatus as in claim 1 wherein said Durometer hardness is more than about 70D.

3. An apparatus as in claim 2 wherein said Durometer hardness is about 72D.

4. An apparatus as in claim 1 wherein said plastic is a polyurethane.

5. An apparatus as in claim 4 wherein said polyurethane plastic has a Durometer hardness of more than about 70D.

6. An apparatus as in claim 5 wherein said polyurethane plastic has a Durometer hardness of more than about 70D.

7. An apparatus as in claim 4 wherein polyurethane tube holder support link is formed by combining two polyurethane resins, each having a Durometer hardness of about 60D to about 90D, said tube holder support link maintained in a compression mold for a period of about 15 minutes to about 60 minutes, and cured in an oven at about 100° C. to about 130° C. for about 12 to 48 hours.

8. An apparatus as in claim 7 wherein said polyurethane resins have a Durometer hardness of about 65D to 85D.

9. An apparatus as in claim 8 wherein the Durometer hardness of said tube holder support link is more than about 70D.

10. An apparatus as in claim 9 wherein the Durometer hardness of said tube holder support link is about 72D.

* * * * *